United States Patent [19]

Doyle et al.

[11] 3,938,358

[45] Feb. 17, 1976

[54] PICK-PROOF LOCK

[76] Inventors: David Doyle, 1768 Horatio Ave., N. Merrick, N.Y. 11566; Murray M. Shtulman, 163-35 130th Ave., Jamaica, N.Y. 11434

[22] Filed: Sept. 10, 1973

[21] Appl. No.: 395,821

Related U.S. Application Data

[63] Continuation-in-part of Ser. No. 199,984, Nov. 18, 1971, abandoned.

[52] U.S. Cl. ..... 70/358; 70/421; 70/419

[51] Int. Cl.[2] ..... E05B 27/06

[58] Field of Search..... 70/356, 358, 364 R, 364 A, 70/375, 379 R, 380, 401, 416, 419, 420, 421

[56] References Cited

UNITED STATES PATENTS

| | | | |
|---|---|---|---|
| 1,905,177 | 4/1933 | Kirkwood | 70/358 |
| 2,032,974 | 3/1936 | Bradshaw | 70/421 |
| 2,070,233 | 2/1937 | Liss | 70/419 X |
| 2,197,673 | 4/1940 | Albertz | 70/395 |
| 2,431,894 | 12/1947 | Spain | 70/419 X |
| 3,078,706 | 2/1963 | Russell | 70/419 |
| 3,500,670 | 3/1970 | Hawkins | 70/375 |
| 3,507,133 | 4/1970 | Basseches | 70/421 |
| 3,670,540 | 6/1972 | Fernandez | 70/421 |

*Primary Examiner*—Roy D. Frazier
*Assistant Examiner*—Peter A. Aschenbrenner
*Attorney, Agent, or Firm*—Peter L. Berger

[57] ABSTRACT

A highly safe, relatively pick-proof lock to be used as a replacement for standard lock cylinders in conventional doors. A plurality of independently operating locking means serving to enhance the difficulty of picking a lock including split keyways, locking cams, shear line blocking means and a hardened steel face plate.

16 Claims, 13 Drawing Figures

PICK-PROOF LOCK

This is a continuation-in-part of application Ser. No. 199,984, filed Nov. 18, 1971, now abandoned.

BACKGROUND OF THE INVENTION

This invention relates to a key-operated locking mechanism, and more particularly, to a key-operated locking mechanism which is relatively pick-proof.

Locks, especially those used for doors, are susceptible to being relatively easily picked permitting unauthorized entry. Persons skilled in the handling of locks insert a specially constructed spring metal shim through the keyway and vibrate it from the keyway to rotate the latch controlled by the lock. This operation involves the application of lengthwise pressure on the shim simultaneously with rotation of it.

Conventional locks are of several types, one of such being a pin tumbler type lock. The pin tumbler lock comprises essentially a cylindrical shell within which rotates a cylinder plug operated by a key. A pin tumbler flange forms part of this cylinder shell and contains the usual pin tumbler bores, which are adapted to align axially with matching pin tumbler bores in the cylinder plug. Pin tumblers in the shell under pressure of springs are urged downwardly against the matching pin tumblers in the cylinder plug where they bottom against a longitudinal rib in the keyway of the cylinder. The cylinder plug cannot be rotated because of the partial projection of the pin tumblers from the bores of the shell into the bores of the cylinder. Following conventional practice, as the key is inserted, appropriate cutouts and projections thereon move the pin tumblers so that when the key is in place, the line of separation between the shell and cylinder plug pin tumblers will fall on the circumference of the cylinder plug defining a shear line and permit the cylinder plug to rotate in the shell.

The pin tumbler lock is easily picked by use of a special tool. The tool comprises essentially a shim which is inserted in the keyway and in turn pushes each of the pin tumbler pairs from blocking the shear line. As each of the pin tumbler pairs is so moved, the cylinder plug is rotated slightly to hold the pin tumblers in the non-blocking position causing the cylinder to eventually be rotated when all of the pin tumbler pairs are so moved. The picking of such locks can be accomplished by a single individual simultaneously using his two hands.

An object of our invention is to provide a pin tumbler lock which is difficult to pick.

Another object of this invention is the provision of a pin tumbler lock which is unlocked by the simultaneous manipulation of a plurality of independent blocking elements.

Still another object of our invention is to provide a pin tumbler lock which cannot be picked by a single individual.

Another object of our invention is to provide such a pin tumbler lock which is adaptable for a plurality of different type locks.

Yet another object of this invention is to provide such a lock which is interchangeable with standard lock cylinder housings so as to enable the invention to serve as a cylinder replacement.

Further and additional objects of our invention will become more apparent from the following description.

SUMMARY OF THE INVENTION

In accordance with the principles of our invention, the above objects are accomplished by providing a key-operated lock, suitable for use in doors and the like, the lock comprising a shell adapted to receive and hold a cylinder plug, the cylinder plug having a keyway and being axially rotatable within the shell, a plurality of movable pin tumblers carried in bores in the shell and cylinder adapted to intersect the line of separation between the shell and cylinder to prevent rotation of the cylinder, the pin tumblers being movable within the bores by respective cuts in a key to clear the line of separation or shear line between the cylinder and shell permitting axial rotation of the cylinder with respect to the shell, there being further provided shear line blocking means extending along the depth of the keyway intersecting the shear line to prevent axial rotation of the cylinder, the shear line blocking means being movable out of the intersecting position by the key to permit axial rotation of the cylinder.

The shear line blocking means comprises a leaf spring anchored at its forward end to the shell and free at its rear end, the leaf spring member traversing the shear line to prevent rotation of the cylinder unless moved out of the blocking position. When the key is inserted in the keyway, the bottom edge of the key pushes the leaf spring member down to clear the shear line so that the cylinder can be rotated.

In accordance with another provision of our invention, we provide two additional blocking means preventing the rotation of the cylinder, all of said blocking or locking means requiring simultaneous actuation to permit cylinder rotation. The keyway is slightly shorter than the key, and the front tip of the key when fully inserted pushes a spring biased member out of a blocking or non-engagement position depending on the type of lock in which our invention is used. Additionally, the key has a plurality of cuts as contrasted with the common conventional single cut found in most keys. All of the cuts simultaneously engage respective pin tumblers in the cylinder and shell. Therefore, with our invention, in order to rotate the cylinder, the plurality of lines of pin tumblers must simultaneously be moved, a leaf spring member must be moved downwardly, and the spring biased member must be moved. As can be easily understood, the provision of the plurality of independent actuable blocking means provides a relatively pick-proof lock since no single person could simultaneously move all the blocking means out of the blocking positions.

In accordance with a further feature of our invention, the cylinder plug comprising the invention is sized so as to fit in standard cylinder plug housing formed within conventional doors. Thus, the present lock can be used as a cylinder replacement for standard cylinders without modification of the other parts of the door or cylinder housing.

DETAILED DESCRIPTION

Figure 1:
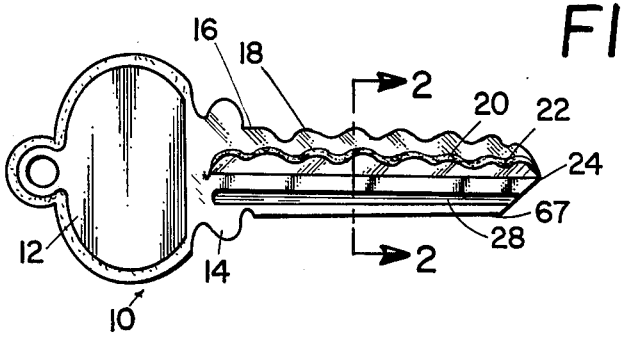
FIG. 1 is a perspective view of a key suitable for use with the lock of our invention.

Referring to the drawings, and in particular to FIG. 1, there is shown a cylinder key 10 used with our invention and which forms a portion thereof. The cylinder key generally resembles a conventional key in which there is a bow portion 12, a shoulder 14, the bow and shoulder portions serving as a handle for the key. Projecting forwardly of the shoulder portion is the blade 16 of the key having thereon a blank cut 18 and cut 20 illustrated as having grooves 22. The front of the key 10 terminates in a tip 24.

Figure 2:
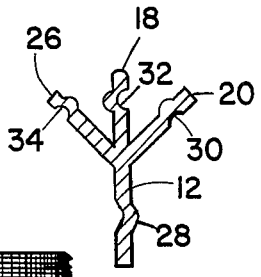
FIG. 2 is a sectional view taken through lines 2—2 of FIG. 1 illustrating the plurality of cuts of the key.

In accordance with the principles of this invention, we provide a key and cylinder in which there are a plurality of angulated cuts all of which must be simultaneously inserted in the cylinder and all of which form an integral part of a single key. Preferably, and as illustrated in FIG. 2, we provide a key having three such cuts 18, 20 and 26 which with the bow or handle portion 12 form a "Peace" symbol. Groove 28 is located along the bottom portion of the blade of the key as is conventional while grooves 30, 32 and 34 are located in cuts 20, 18 and 26, respectively, as is also conventional when there is only a single cut. The cuts 30, 32 and 34 serve as stops for the pin tumblers as will be described hereinafter.

As will be described below, the three cuts are adapted to match with three sets of pin tumblers in the cylinder and shell to provide a clearance at the shear line when the key is inserted in the lock.

The present invention is illustrated for use with a mortise lock as shown in FIGS. 1 through 10. The key illustrated in FIG. 1 having a plurality of cuts, such as three, may be used with any of the mortise, rim or padlock type locks and, for purposes of clarity, the invention will first be described with reference to the lock illustrated in FIGS. 8 through 10.

Referring now to those Figures, there is shown the key 10 inserted in a keyway 36, the keyway 36 being located within cylinder plug 38. The cylinder plug is adapted to fit in and be inserted in a shell 40. The shell 40 and cylinder plug assembly 38 are adapted to fit within a conventional cylinder housing 41 which provided with threads 100 adapted to receive the threaded portion of the conventional cylinder for holding the cylinder in place. This cylinder housing 41 is located within a conventional door 102 of a conventional thickness. The present invention is sized so as to be interchangeable with standard cylinders so as to be easily used as a replacement cylinder without requiring modification of the cylinder housing or door. Thus, there is incorporated within our invention a movable rear cam member or plate 69 which moves away from the main cylinder plug portion 38 of the lock. The lock is sized so as to provide sufficient clearance for the plate 69 to so move in a space 104 located within the housing 40 and behind the plug or cylinder 38.

Figure 10:
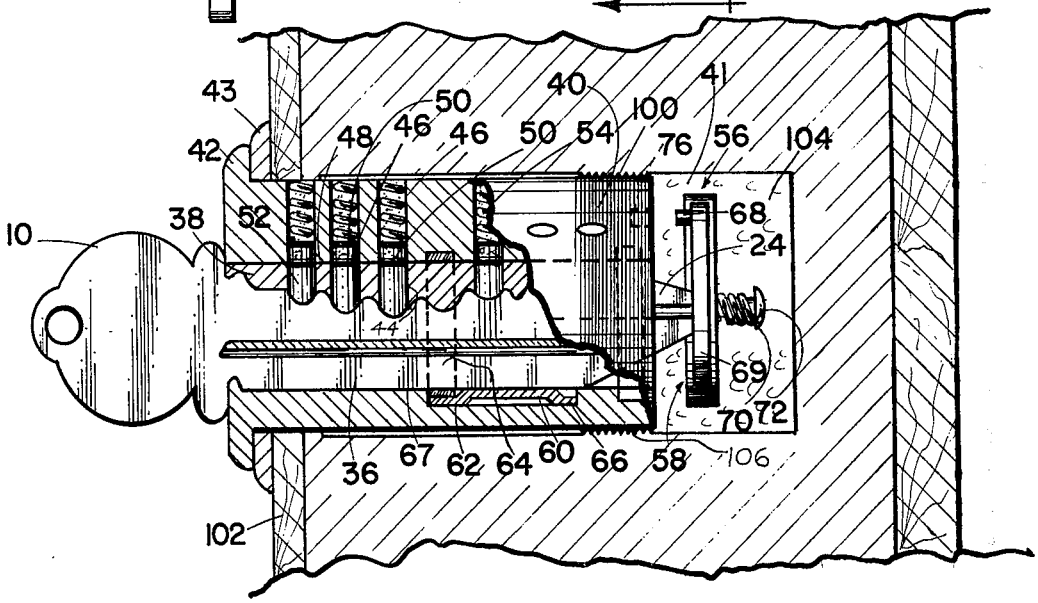
FIG. 10 is a partial sectional broken view along lines 10—10 of FIG. 9.

Referring more particularly to FIG. 10, there is shown the key 10 inserted in the keyway 36. When inserted in door 102, a hardened steel face front 42 is provided to prevent access to the cylinder and shell with a steel ring 43 located therebehind. The cylinder and shell are each provided with bores 44 and 46 respectively, the bores 44 of the cylinder 38 axially aligning with the bores 46 of the shell. As described above with reference to FIGS. 1 and 2, the key is provided with three cuts and therefore there will be three rows of associated bores in the shell and cylinder, respectively.

Between the cylinder and the shell, there is a clearance which is known as the shear line 48, and when the shear line is clear, the cylinder can axially rotate within the shell.

Pin tumblers 50 are located in the shell bores 46 while pin tumblers 52 are located in the bores 44 of the cylinder plug 38. Pin tumblers 50, under pressure of springs 54, are urged downwardly against the matching pin tumblers 52 in the cylinder bores 44, the pin tumblers 52 being moved thereby through action of the spring 54 downwardly to positions where they bottom against a longitudinal rib (not shown) in the keyway 36.

Following conventional practice, when the key is inserted, appropriate cut-outs and projections match the pin tumblers 50 and 52 so that when the key is in place the line of separation between the pin tumblers 50 and the pin tumblers 52 will fall on the circumference of cylinder plug 38 and permit the plug to axially rotate within the shell 40. As may be readily understood, the peace key and peace lock provide a plurality of such independent and separate cuts, so that all three cuts and respective pin tumblers must be simultaneously moved to permit clearance of the shear line and rotation of the cylinder plug within the shell.

The axial rotation of cylinder 38 is transmitted to the tail piece assembly 56 by means of a coupler 58 so that as the cylinder rotates, the tail piece will similarly rotate to operate a suitable latching mechanism. In accordance with the principles of this invention, we provide additional blocking means to prevent the rotation of the cylinder within the shell so as to prevent the easy picking of the cylinder lock. As described above, provision of the plurality of cuts on one key affords one degree of improvement with regard to the conventional single cut key.

Figure 7:
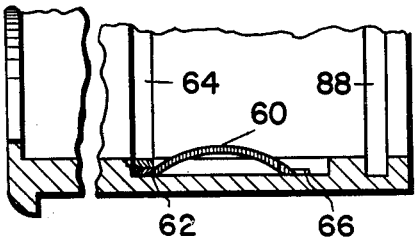
FIG. 7 is a sectional view taken along lines 7—7 of FIG. 6 illustrating one of the blocking means utilized in our invention.

In accordance with out invention, we provide an additional blocking means 60 anchored in the shell 40, the blocking means 60 comprising a leaf spring member having the forward end thereof 62 held in place by a retaining ring 64 with the free end 66 of the spring member adapted to be above the shear line 48. The provision of leaf spring member 60 intersecting the shear line 48 prevents rotation of the cylinder unless the leaf spring 60 is moved out of the blocking position. In accordance with our invention, leaf spring member 60 extends along the depth of the keyway as illustrated in FIGS. 10 and 7 and is moved out of the blocking position by the bottom edge 67 of the key 10. The lock picker will simultaneously have to control the three sets of pin tumblers and the leaf spring member 60 to be able to pick the lock. As can be understood, such manipulation is difficult for a single person since opposite forces must be simultaneously applied.

Figure 8:
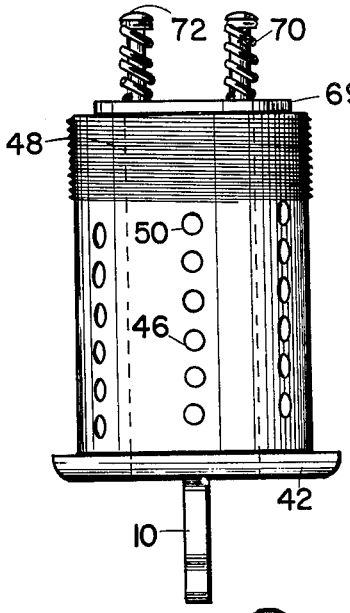
FIG. 8 is another embodiment of our lock with the key being inserted into the lock.
Figure 9:
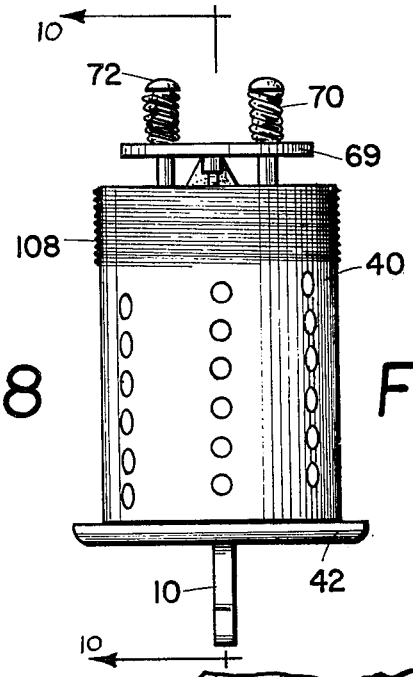
FIG. 9 is a view similar to FIG. 8 illustrating the key being fully inserted into the lock to release one of the blocking means.

In accordance with still another feature of this invention, we provide a projecting blocking pin 68 attached to the tail piece 56 and coupler 58 as will be described hereinafter. The blocking pin 68 is attached to a plate 69 located behind the shell 40 as illustrated in FIG. 10. A spring 70 is carried on rod means 72, there being provided a pair of such rod and spring means 70 and 72 as illustrated in FIGS. 8 and 9. The rod and spring means normally urge plate 69 towards the shell, thereby causing projecting member 68 to engage a recess 76 in the shell member 40. In this position, the tailpiece is fixed to the shell and is prevented from rotating with respect thereto even when the cylinder is free to rotate. The movable plate 69 operates the latch mechanism (not shown) which allows the door to be opened. The outside of the shell is provided with threads 106 adapted to engage threads 100 of the housing to effect its location therein.

In accordance with our invention, the key 10 is made slightly longer than the keyway, with the tip 24 of the key urging the plate 69 rearwardly when the key is fully inserted to move the blocking pin 68 from recess 76. When so withdrawn, the tailpiece will be free to rotate under control of the cylinder 38. Rotation of the tailpiece imparts different action to the latching mechanism in accordance with the type lock utilized.

As described above, it may clearly be seen that our invention provides three separate and independent simultaneously operable blocking means each of which alone prevents rotation of the cylinder and/or tailpiece. Thus, the thief in attempting to pick our "Peace" lock will have to simultaneously control three sets of pin tumblers, leaf spring 60, and blocking pin member 68, all of said blocking means requiring force to simultaneously be exerted in different directions. As may be clearly understood, it is almost impossible for a single person to provide such oppositely directed forces and therefore, our present lock is relatively pick-proof.

Referring to FIG. 7, there is shown the leaf spring member 60 being held in place by means of the retaining clip 64, the leaf spring held within a slot 84 in the shell. The shell is also provided with a milled out portion 86 (FIG. 5) for receiving the retaining clip 64 and holding the same within the shell. The mortise type cylinder, as illustrated in FIG. 3, is held in place by means of a retaining ring 88 located at the rear end of the keyway 36, which fixedly maintains the cylinder within the shell 40.

Figure 3:
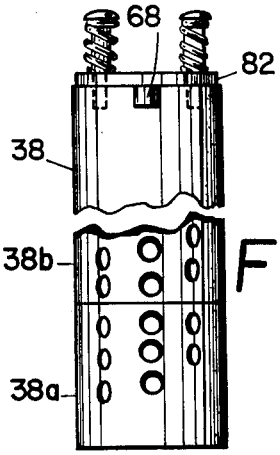
FIG. 3 is a top view of one embodiment of the cylinder of this invention.
Figure 5:
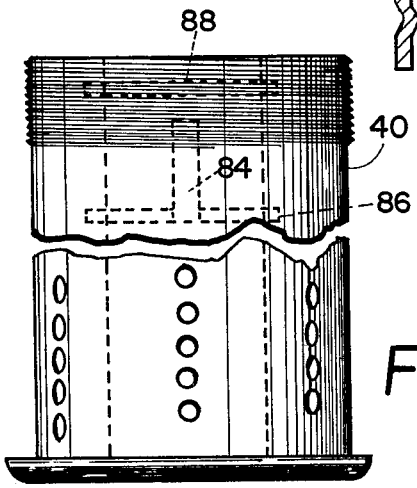
FIG. 5 is a top view of the shell used with the cylinder of this invention.
Figure 4:
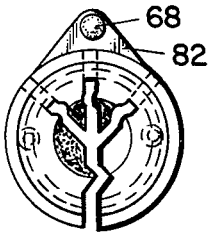
FIG. 4 is a front view of the cylinder illustrated in FIG. 3.
Figure 6:
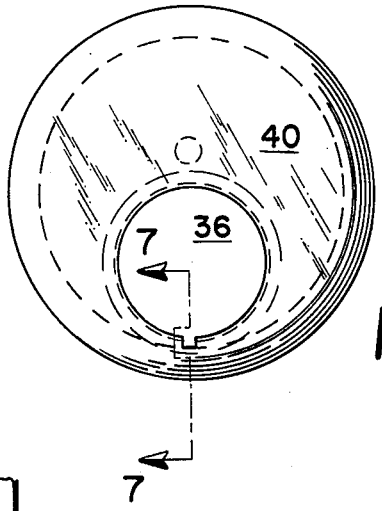
FIG. 6 is a front view of the shell of FIG. 5.

In accordance with another feature of this invention, we provide a segmented cylinder as illustrated in FIG. 3, with segments 38*a* and 38*b* being independent and separately rotatable, so that pressure exerted at one portion of the keyway by means of a shim cannot be used to control the position of the other of the segmented portions of the cylinder. This feature also makes the picking of our lock even more difficult. The cylinder could be a single piece as illustrated with regard to the rim lock of FIGS. 8 through 10 or the segmented type cylinder comprising segments 38*a* and 38*b*.

Figure 11:
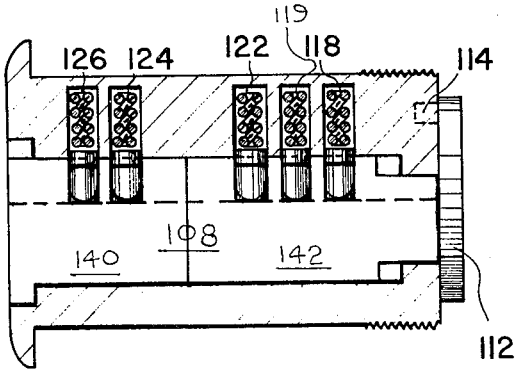
FIG. 11 is a sectional view of a second embodiment of the shell of our invention.
Figure 12:
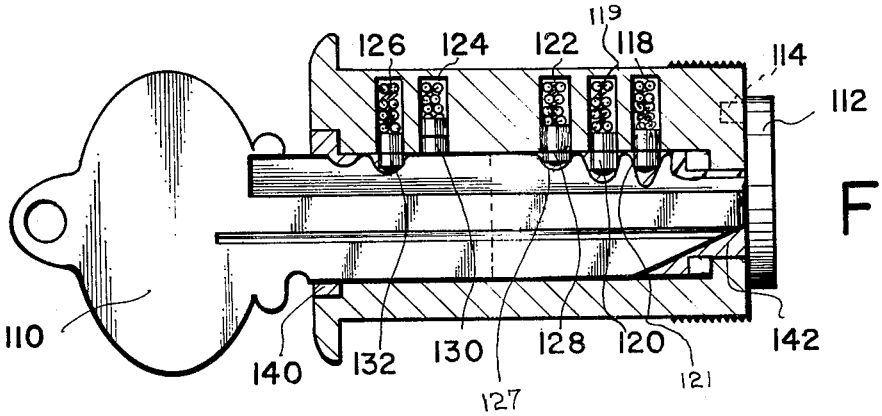
FIG. 12 is a sectional view of the second embodiment with a key inserted in the cylinder.
Figure 13:
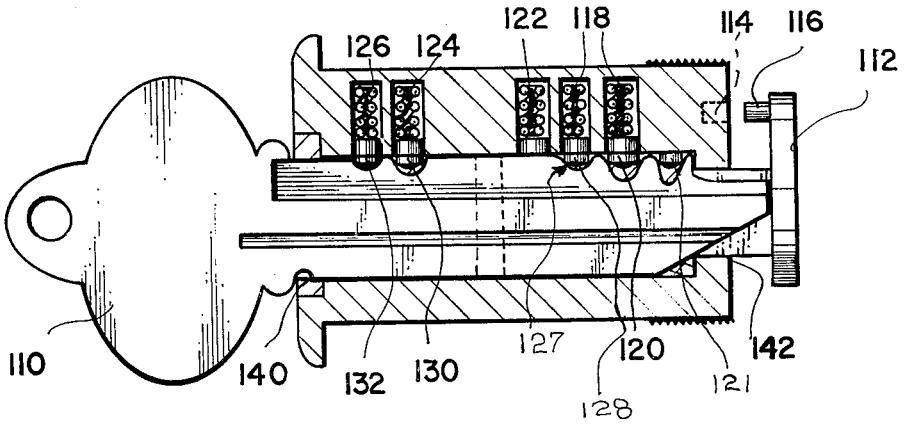
FIG. 13 is a sectional view similar to FIG. 12 with the key fully inserted.

Referring now to FIGS. 11–13, there is shown another embodiment of our invention. In particular, there is shown a cylinder plug 108 having a split keyway 140 and 142 which is similar to the split keyway discussed above with regard to FIG. 3. The cylinder 108 is a solid piece having its distal end integrally connected with rear cam plate 112 which is similar to plate 69 of FIG. 10. Attached to cam plate 112 is a projecting pin 116 adapted to fit within recess 114, recess 114 being located within the rear surface of the lock similar to elements 68 and 76 of FIG. 10. There is also shown shell and cylinder pin tumblers 118, 119, 122, 124 and 126 which correspond with cylinder pin tumblers 121, 120, 128, 130 and 132 respectively. There is also shown a key 110 having a plurality of cuts, and it should be noted that cut 127 is illustrated in FIGS. 12 and 13. It should be noted that the embodiment in FIGS. 11–13 is shown without the bottom spring 60, although it is understood that this spring, of course, could be incorporated as shown in FIG. 10 at the bottom of the key 110.

The operation of the embodiment illustrated in FIGS. 11–13 is as follows. The key is inserted as shown in FIG. 12. In this position, the respective cuts corresponding to the pin tumblers in the shell and cylinder allow the shear line to be cleared enabling the key 110 to be pushed further into the keyway. The bottom cylinder pin 128 is carried one position deeper into the split keyway 142 so that it aligned with shell pin 119 while cylinder pin 120 now aligns with shell pin 118. This allows the shear line still to be cleared while enabling the key to move further into the keyway pushing the rear cam plate 112 outwardly from the back of the plug so as to free pin 116 from engagement in recess 114. In all other respects, the key functions similarly to that illustrated in FIGS. 1–10. When the key is to be removed, cut 127 acts as a positive drive against bottom or cylinder pin 128 pulling the rear plate 112 with it so as to cause pin 116 to engage with recess 114, thereby blocking further rotational movement.

It should be noted that the arrangement illustrated in FIGS. 11 through 13 function similarly to the spring 70 and rod means 72. The arrangement provided in FIGS. 11 through 13 is even more compact than that shown in FIGS. 8–10, and therefore, further allows the present invention to be substituted for a standard lock cylinder, since the dimensions found in such a cylinder can be conveniently and easily met by the novel arrangement presented in FIGS. 11–13.

It will thus be seen that the objects set forth above, among those made apparent from the preceding description, are efficiently attained and, since certain changes may be made in the above apparatus without departing from the scope of the invention, it is intended that all matter contained in the above description and shown in the accompanying drawings shall be interpreted as illustrative and not in a limiting sense.

We claim:

1. A key-operated locking mechanism for use in conventional latch-operated doors having a conventional cylinder plug housing said mechanism comprising a cylinder plug comprising said latch and having a keyway, a shell aligned with and adapted to receive and hold said cylinder plug, said cylinder plug and shell assembly adapted to fit within said conventional plug housing so as to be a replacement for a standard cylinder assembly, said cylinder plug being axially rotatable within said shell, a plurality of bores located in said shell, a plurality of bores located in said cylinder plug axially aligned with said bores in said shell, a plurality of sets of movable pin tumblers carried in said shell and cylinder plug bores connecting said shell to said cylinder plug and intersecting the clearance between said shell and cylinder plug, said pin tumblers blocking said axial rotation of said cylinder plug in said shell, said pin tumblers being movable within said bores by respective cuts in a key to clear said clearance between said shell and said cylinder plug and provide a shear line clearance permitting axial rotation of said cylinder plug within said shell, a latching means connected to said cylinder plug, coupling means coupling said axial rotational movement of said cylinder plug to operate said latching means, a plate, blocking pin means carried on said plate, a recess at the rear of said shell for receiving said blocking pin means, a pair of guide pins having one end respectively attached to the rear of said plug, spring members bearing against said plate and attached to said guide pins to force said blocking pin means into said recess, said plate being directly moved by the front end of the key to move said blocking pin out of engagement with said recess.

2. A key-operated locking mechanism as set forth in claim 1, further comprising shear line blocking means extending along said keyway intersecting said shear line to block said axial rotation of said cylinder, said shear line blocking means being movable out of said intersecting position by said key.

3. A key-operated locking mechanism as set forther in claim 2 wherein said shear line blocking means comprises a flexible leaf spring member attached at only one end to said shell.

4. A key-operated locking mechanism as set forth in claim 3, wherein said leaf spring member is located in the bottom portion of the keyway of said mechanism, the bottom edge of said key downwardly moving said leaf spring member to enable said cylinder to axially rotate.

5. A key-operated mechanism as set forth in claim 1, wherein said key is slightly longer than said keyway.

6. A key-operated mechanism as set forth in claim 1, wherein said cylinder comprises a plurality of independent keyways.

7. A key-operated mechanism as set forth in claim 6, wherein said cylinder comprises three keyways and said key comprises three cuts.

8. A key-operated mechanism as set forth in claim 6, wherein said cylinder comprises three upwardly projecting keyways and said key comprises three upwardly projecting cuts.

9. A key-operated mechanism as set forth in claim 1, wherein said cylinder plug comprises a plurality of independent cylindrical segments axially aligned.

10. A key-operated mechanism as set forth in claim 1, wherein said shell is provided with a threaded portion adapted to engage a conventional threaded portion on said conventional housing.

11. A key-operated locking mechanism for use in conventional latch-operated doors having a conventional cylinder plug housing, said mechanism comprising a cylinder plug for operating said latch and having a keyway, a shell aligned with and adapted to receive and hold said cylinder plug, said cylinder plug and shell assembly adapted to fit within said conventional cylinder plug housing so as to be a replacement for a standard cylinder assembly, said cylinder plug being axially rotatable within said shell, a set of bores located in said shell, a set of bores located in said cylinder plug axially aligned with said bores in said shell, sets of movable pin tumblers carried in said shell and cylinder plug bores connecting said shell to said cylinder plug and intersecting the clearance between said shell and cylinder, said pin tumblers blocking said axial rotation of said cylinder in said shell, said pin tumblers being movable within said bores by respective cuts in a key to clear said clearance between said shell and said cylinder and provide a shear line clearance permitting axial rotation of said cylinder within said shell, a latching means connected to said cylinder, coupling means coupling said axial rotational movement of said cylinder to operate said latching means, a plate, blocking pin means carried on said plate, a recess at the rear of said shell for receiving said blocking pin means, said plate carrying said blocking pin means thereon and being integrally formed with said cylinder plug, said cylinder plug being moved inwardly by said key to simultaneously cause said blocking pin to move rearwardly out of engagement with said recess.

12. A key-operated locking mechanism as set forth in claim 11, wherein said cylinder is movable inwardly with respect to said shell for carrying said pin into engagement with said recess.

13. A key-operated locking mechanism as set forth in claim 12, wherein at least two of said bores in said shell are separated by a fixed distance, said cylinder being moved by said key for said fixed distance causing a cylinder tumbler to align with the next shell tumbler to permit shear line clearance to be maintained when said key is fully inserted.

14. A key-operated locking mechanism as set forth in claim 13, wherein said cylinder is moved by a cut in said key directly driving at least one of said cylinder plugs inwardly and outwardly as said key is inserted and withdrawn respectively.

15. A key-operated locking mechanism as set forth in claim 11, further comprising shear line blocking means extending along said keyway intersecting said shear line to block said axial rotation of said cylinder, said shear line blocking means being movable out of said intersecting position by said key.

16. A key-operated locking mechanism as set forth in claim 15, wherein said shear line blocking means comprises a leaf spring member located in the bottom portion of the keyway of said mechanism, the bottom edge of said key downwardly moving said leaf spring member to enable said cylinder to axially rotate.

* * * * *